US005226021A

United States Patent [19]

Dell'Olio

[11] Patent Number: 5,226,021

[45] Date of Patent: Jul. 6, 1993

[54] TRAIN SIMULATION ALARM CLOCK APPARATUS

[76] Inventor: Matthew P. Dell'Olio, 2026 Woodlawn Dr., Conway, S.C. 29256

[21] Appl. No.: 944,286

[22] Filed: Sep. 14, 1992

[51] Int. Cl.[5] ..... G04B 47/00; G04B 45/00; G04C 21/00

[52] U.S. Cl. ..... 368/12; 368/45; 368/250; 368/274; 368/276

[58] Field of Search ..... 368/10, 12, 45, 63, 368/72-75, 243, 244, 250, 272-274, 276, 285, 361-317

[56] References Cited

U.S. PATENT DOCUMENTS 4,097,905 6/1978 Kramer ..... 368/12

4,730,284 3/1988 Adams ..... 368/272

5,047,998 9/1991 Aizawa et al. ..... 368/75

*Primary Examiner*—Vit W. Miska

*Attorney, Agent, or Firm*—Leon Gilden

[57] ABSTRACT

An alarm clock structure configured of a simulation train structure is provided with the alarm in electrical communication with a cassette tape to effect actuation of the cassette tape and its play for simulation of various train audio reproductions, wherein the organization may optionally be provided with a chamber within the locomotive portion of the structure in electrical communication with the alarm of the clock to effect heating of a container therewithin to project simulation steam and smoke from the structure.

4 Claims, 5 Drawing Sheets

TRAIN SIMULATION ALARM CLOCK APPARATUS

BACKGROUND OF THE INVENTION

1. Field of the Invention

The field of invention relates to alarm clock apparatus, and more particularly pertains to a new and improved train simulation alarm clock apparatus wherein the same is arranged to effect the simulation of an on-coming train at various stages permitting replacement of the tape structure to accommodate various train audio reproductions.

2. Description of the Prior Art

Alarm clock structure of various types have been utilized throughout the prior art to direct an audio response relative to the clock structure attaining a predetermined and programmed time. The instant invention attempts to overcome deficiencies of the prior art by utilizing an alarm clock structure to reproduce a soothing train audio signal for its soothing effects to induce sleep and to alert and awaken individuals and in this respect, the present invention substantially fulfills this need.

SUMMARY OF THE INVENTION

In view of the foregoing advantages inherent in the known types of alarm clock apparatus now present in the prior art, the present invention provides a train simulation alarm clock apparatus wherein the same is arranged to simulate audio signals of an on-coming train and the like. As such, the general purpose of the present invention, which will be described subsequently in greater detail, is to provide a new and improved train simulation alarm clock apparatus which has all the advantages of the prior art alarm clock apparatus and none of the disadvantages.

To attain this, the present invention provides an alarm clock structure configured of a simulation train structure, with the alarm in electrical communication with a cassette tape to effect actuation of the cassette tape and its play for simulation of various train audio reproductions, wherein the organization may optionally be provided with a chamber within the locomotive portion of the structure in electrical communication with the alarm of the clock to effect heating of a container therewithin to project simulation steam and smoke from the structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved train simulation alarm clock apparatus which has all the advantages of the prior art alarm clock apparatus and none of the disadvantages.

It is another object of the present invention to provide a new and improved train simulation alarm clock apparatus which may be easily and efficiently manufactured and marketed.

It is a further object of the present invention to provide a new and improved train simulation alarm clock apparatus which is of a durable and reliable construction.

An even further object of the present invention is to provide a new and improved simulation alarm clock apparatus which is susceptible of a low cost of manufacture with regard to both materials and labor, and which accordingly is then susceptible of low prices of sale to the consuming public, thereby making such train simulation alarm clock apparatus economically available to the buying public.

Still yet another object of the present invention is to provide a new and improved train simulation alarm clock apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
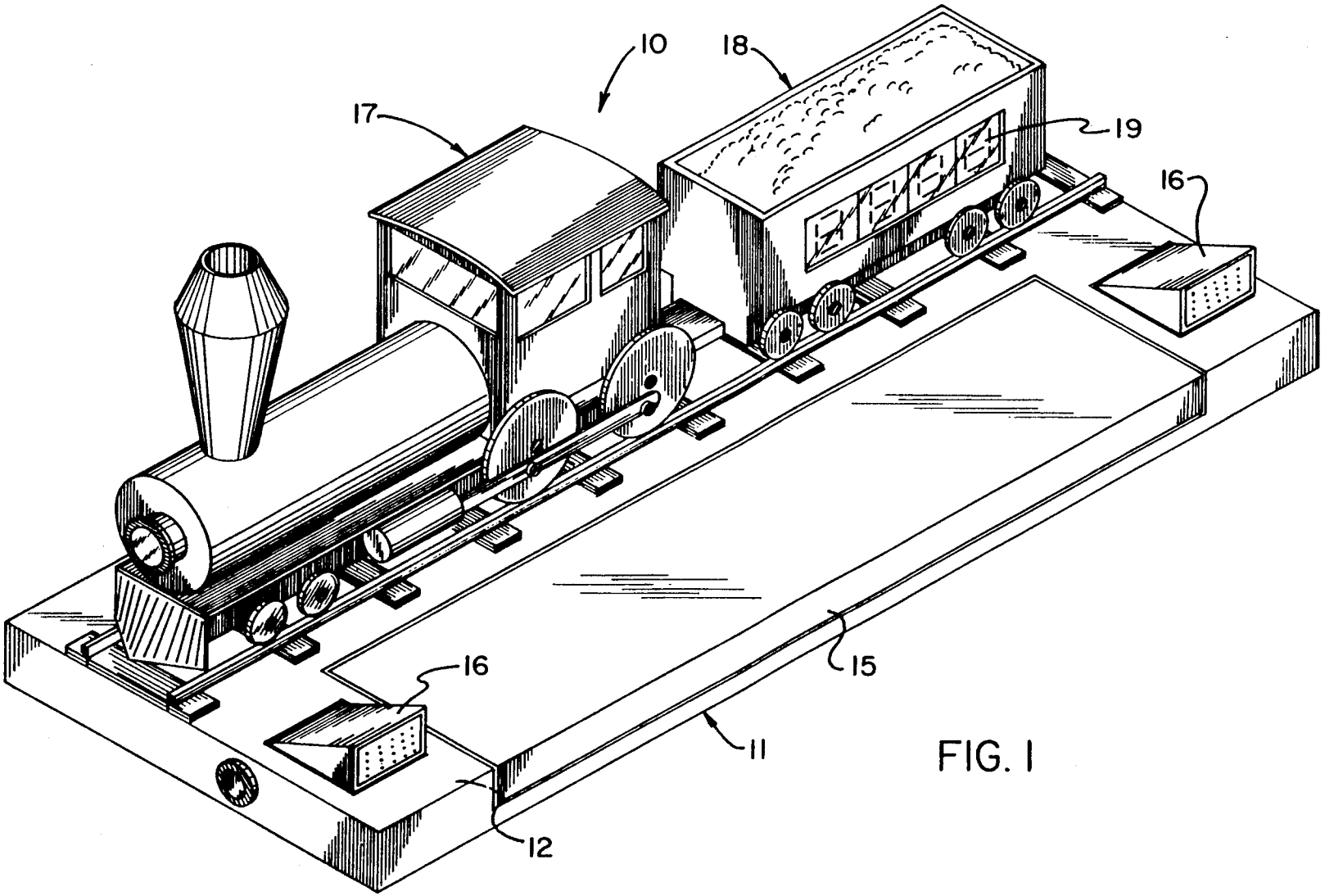
FIG. 1 is an isometric illustration of the instant invention.

With reference now to the drawings, and in particular to FIGS. 1 to 9 thereof, a new and improved train simulation alarm clock apparatus embodying the principles and concepts of the present invention and generally designated by the reference numeral 10 will be described.

Figure 2:
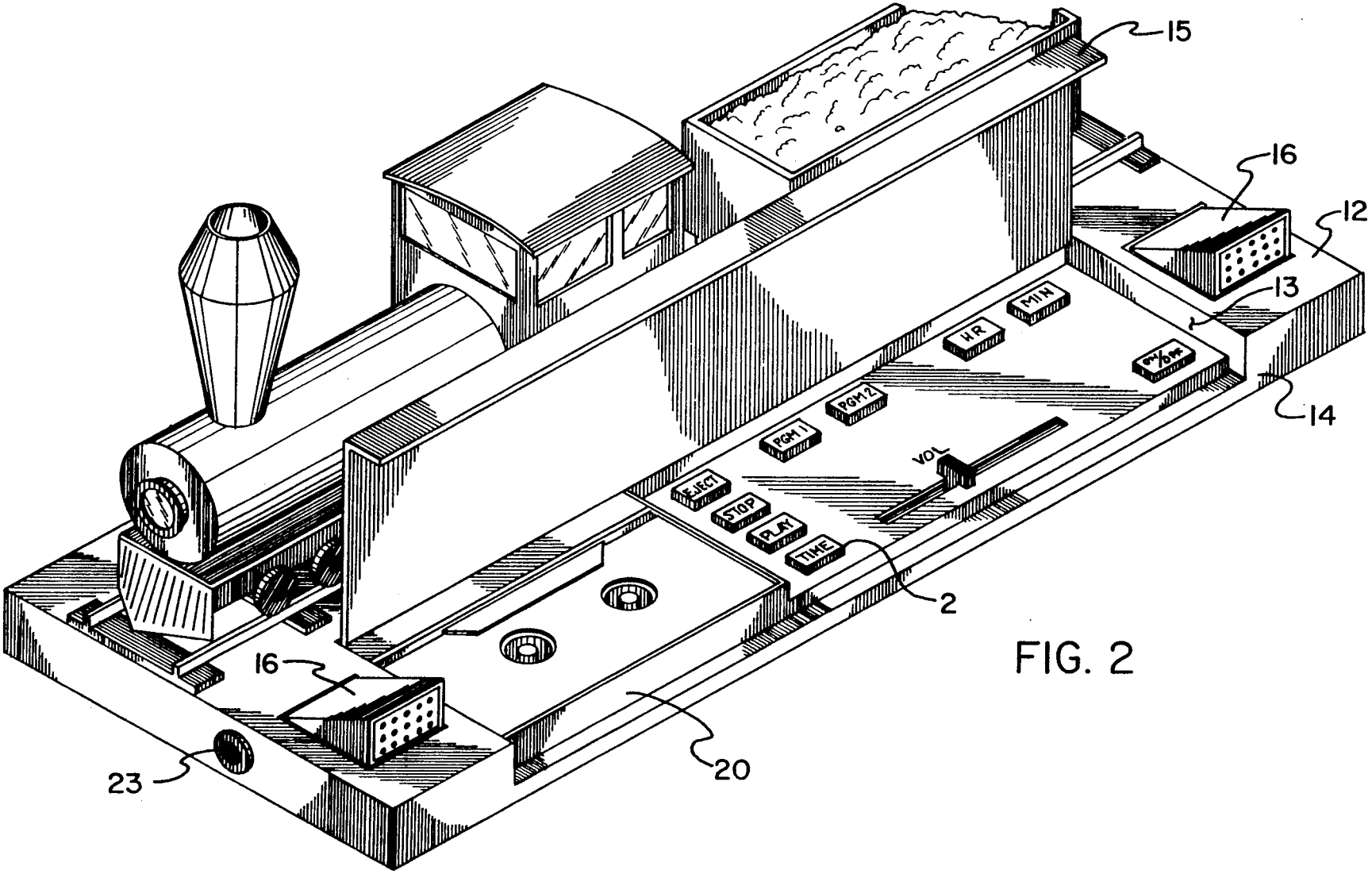
FIG. 2 is an isometric illustration of the invention indicating the lid lifted to provide access to the control mechanism of the invention.
Figure 4:
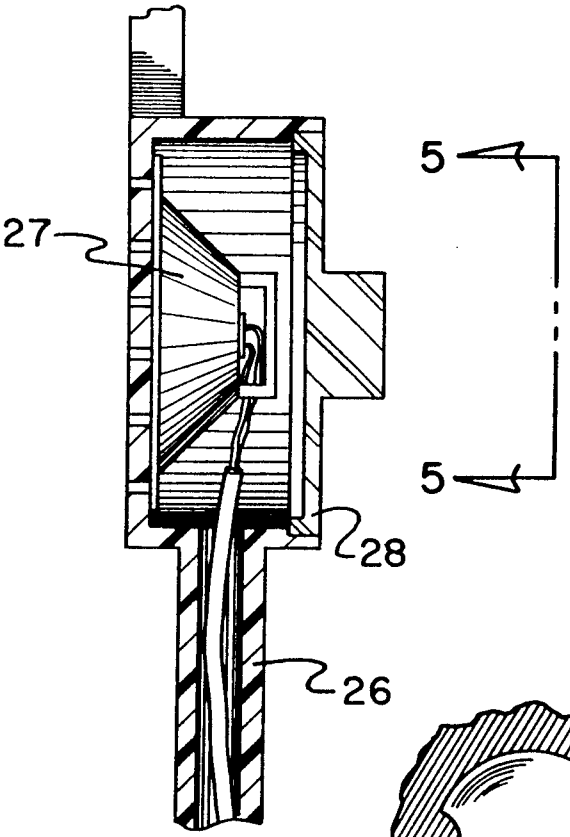
FIG. 4 is an orthographic view, taken along the lines 4—4 of FIG. 3 in the direction indicated by the arrows.
Figure 5:
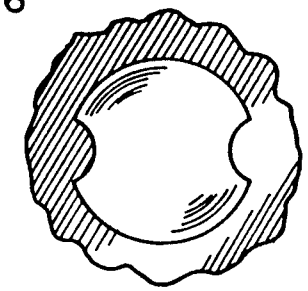
FIG. 5 is an orthographic view, taken along the lines 5—5 of FIG. 4 in the direction indicated by the arrows.

More specifically, the train simulation alarm clock apparatus 10 of the instant invention essentially comprises a base 11 having a base top wall 12, with a base cavity 13 directed into the base through the top wall 12 and a front wall 14 of the base. A cover lid 15 is hingedly mounted to the base 11 permitting selective access to the cavity 13, in a manner as indicated in FIG. 2. An audio speaker 16 is positioned on each side of the cover lid 15 to the top wall 12. A simulated train locomotive 17, with a train tender 18, is mounted to the top wall rearwardly of the lid to provide for an abutment for the lid when in a raised second position, as indicated in FIG. 2, from the lowered first position, as indicated in FIG. 1, with the lid arranged in a coplanar orientation relative to the base top wall 12. The tender 18 is provided with a clock member 19 in operative communication with the controls of the organization 21. The controls permit selective programming of the hour and minute relative to the clock member 19 to provide for actuation of the alarm mechanism in a conventional manner, wherein the alarm mechanism includes a cassette tape 20 and associated player mounted within the cavity 13 to simultaneously actuate the tape upon actuation of the alarm that has been programmed. The tape 20 is utilized to direct various simulations of trains oncoming and departing providing the effect of realism relative to a stationary individual.

Figure 3:
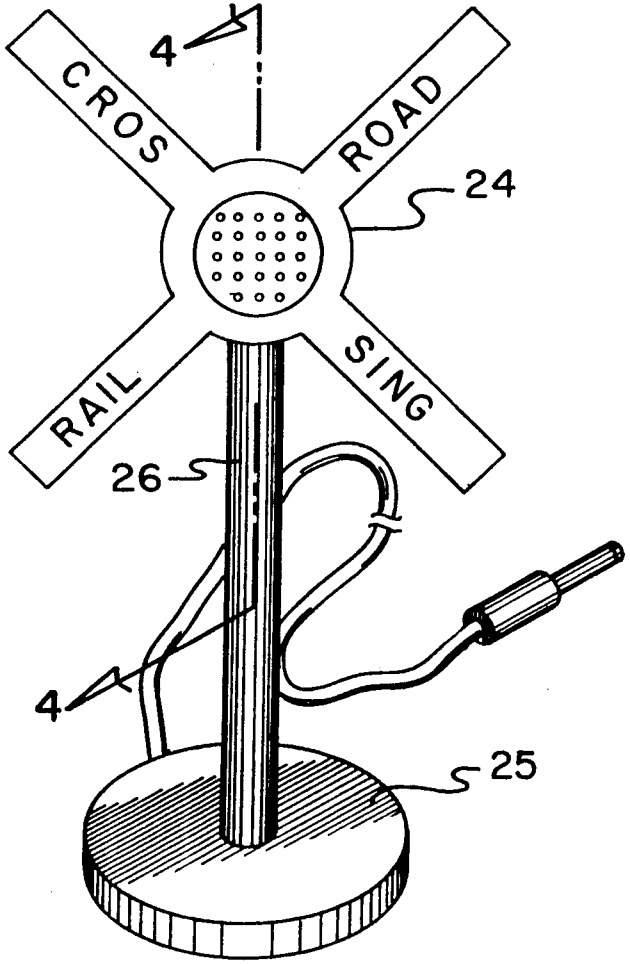
FIG. 3 is an isometric illustration of an auxiliary speaker structure utilized by the invention.
Figure 6:
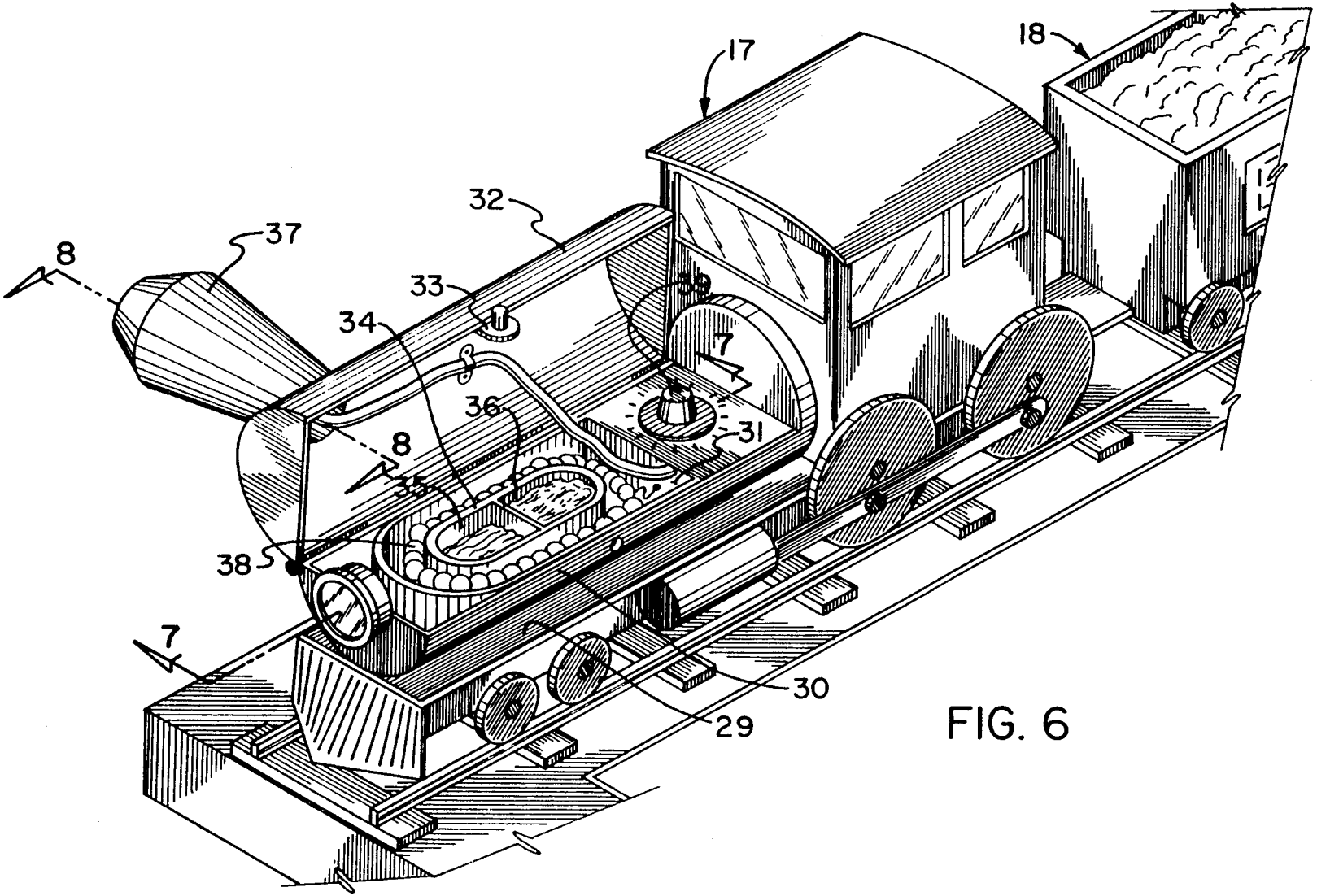
FIG. 6 is an isometric illustration of the invention including a smoke and steam distribution container within the locomotive structure.
Figure 8:
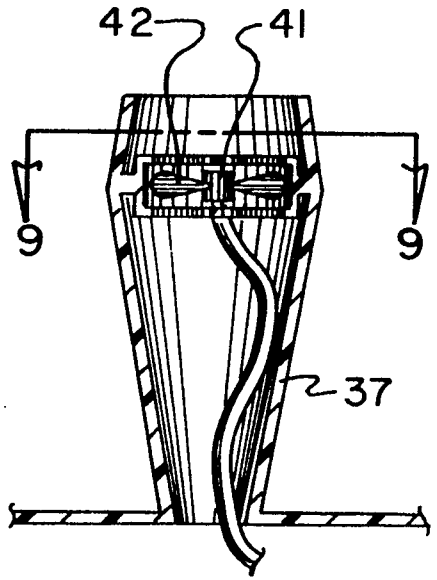
FIG. 8 is an orthographic view, taken along the lines 8—8 of FIG. 6 in the direction indicated by the arrows.
Figure 7:
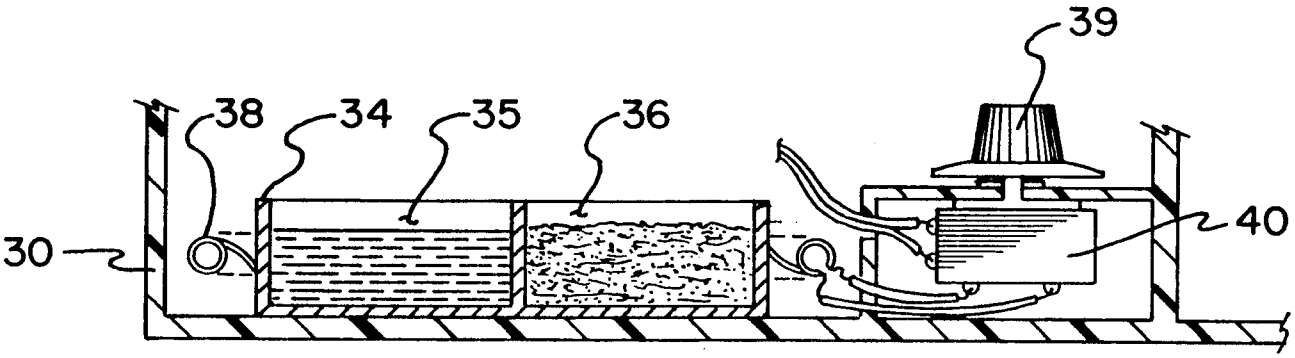
FIG. 7 is an orthographic view, taken along the lines 7—7 of FIG. 6 in the direction indicated by the arrows.
Figure 9:
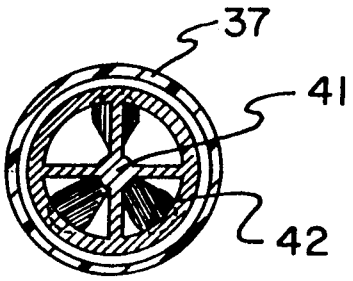
FIG. 9 is an orthographic view, taken along the lines 9—9 of FIG. 8 in the direction indicated by the arrows.

Extension jacks 23 are provided in the side walls of the base 11 permitting use of additional audio speaker assemblies 24 of a type exemplified in FIG. 3, with each audio speaker assembly 24 having an audio speaker 27 mounted therewithin within an audio speaker housing 28 that in turn is positioned to an upper distal end of a post 26 orthogonally mounted to a speaker base 25.

The train locomotive 17 is arranged as indicated in FIGS. 6–9 to include a locomotive base 29 having a semi-cylindrical body 30 provided with a body cavity 31, with a cooperative and complementary semi-cylindrical body lid 32 arranged for securement to the semi-cylindrical body 30 by a latch 33 cooperating with the body 30. The semi-cylindrical body 30 and the body lid 32 are arranged to configure as a generally cylindrical configuration to simulate the locomotive steam generating aspect of the invention. The body 30 includes a partition container 34 having a first and second container chamber 35 and 36. The first chamber 35 includes a scented fragrance 35 therewithin, while the second chamber 36 includes a cellular fibrous granular material, with a heating coil 38 arranged in surrounding relationship relative to the container 34, whereupon a rheostat control 40 is provided utilizing a dial 39 to effect selective heating of the chamber and thereby providing scented fragrance to be directed from the locomotive 17 as well as smoke to simulate a locomotive in a more realistic manner in association with the audio actuation of the cassette tape 20. A lid chimney tube 37 is directed and mounted fixedly to the lid in communication with and overlying the container 34, whereupon heating of the fragrance and the fibrous material within the first and second chambers 35 and 36 directs the fragrance and the smoke from the semi-cylindrical body 30. To assist in such projection of fragrance and its dispersion about a room and the like, a fan motor 41 mounted within the chimney tube 37 is cooperative with fan blades 42 that are simultaneously actuated along with the heating coil and actuation of the cassette tape 20 upon the alarm mechanism by the alarm clock structure 19 being actuated to simultaneously actuate the cassette tape and the smoke and fragrance, as well as the fan motor, to provide for a total visual, olfactory, and audio replication of a train member.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A train simulation alarm clock apparatus, comprising, a base, the base having a top wall, and a front wall, with a base cavity directed into the base through the top wall and the front wall, and a cover lid hingedly mounted to the top wall, and a simulated train locomotive mounted to the top wall, with the cover lid arranged from a first position to a second position exposing the base cavity, with the cover lid arranged for abutment with the train locomotive in the second position, and at least one audio speaker mounted to the top wall, and a simulated train tender mounted to the locomotive and to the top wall, with a clock member mounted within the train tender, and a cassette tape and player mounted within the base cavity arranged for play of simulated train audio signals, and control means mounted within the base cavity for effecting actuation of the cassette tape upon the clock member attaining the programmed time.

2. An apparatus as set forth in claim 1 wherein the base includes at least one extension jack, and an audio speaker assembly arranged for audio inter-relationship to the speaker through the extension jack, wherein the speaker assembly includes a speaker base and a speaker post mounted to the speaker base, with a speaker housing mounted to the post spaced from the speaker base, with an audio speaker mounted within the speaker housing.

3. An apparatus as set forth in claim 2 wherein the locomotive includes a locomotive base having a semi-cylindrical body mounted thereon, the semi-cylindrical body including a body cavity, and a semi-cylindrical body lid hingedly mounted to the semi-cylindrical body, and a lid latch mounted to the body lid arranged for securement of the body lid to the semi-cylindrical body, and a lid chimney tube mounted to the body lid in communication with the cylindrical body, and a container mounted within the semi-cylindrical body, with the container having a first chamber and a second chamber, and a partition wall between the first chamber and the second chamber, the first chamber including a scented fragrance, the second chamber having a fibrous particulate, with a heating coil mounted in surrounding relationship relative to the container to effect directing the scented fragrance and the fibrous material through the chimney tube, the chimney tube positioned over the container.

4. An apparatus as set forth in claim 3 wherein the heating coil is arranged for simultaneous actuation with the cassette tape by the control means, and a fan motor arranged for simultaneous actuation upon actuation of the heating coil, with the fan motor mounted within the chimney tube, the fan motor having a plurality of fan blades thereabout to direct fragrance and smoke from the semi-cylindrical body and the body lid exteriorly of the train locomotive.

* * * * *